US012660871B2

(12) United States Patent
Okugawa et al.

(10) Patent No.: US 12,660,871 B2
(45) Date of Patent: Jun. 23, 2026

(54) COLD PROTECTION MATERIAL

(71) Applicant: DEE LAB CO., LTD., Osaka (JP)

(72) Inventors: Takahiro Okugawa, Osaka (JP); Naoki Honda, Osaka (JP)

(73) Assignee: DEE LAB CO., LTD., Osaka (JP)

( * ) Notice: Subject to any disclaimer, the term of this patent is extended or adjusted under 35 U.S.C. 154(b) by 882 days.

(21) Appl. No.: 17/912,616

(22) PCT Filed: Dec. 24, 2020

(86) PCT No.: PCT/JP2020/048467

§ 371 (c)(1),
(2) Date: Sep. 19, 2022

(87) PCT Pub. No.: WO2022/137437

PCT Pub. Date: Jun. 30, 2022

(65) Prior Publication Data

US 2023/0024924 A1 Jan. 26, 2023

(51) Int. Cl.
*A41D 31/06* (2019.01)
*A41D 31/14* (2019.01)

(52) U.S. Cl.
CPC ..... *A41D 31/065* (2019.02); *A41D 31/145* (2019.02); *A41D 2500/10* (2013.01); *A41D 2500/20* (2013.01); *A41D 2500/30* (2013.01); *Y10T 442/3699* (2015.04)

(58) Field of Classification Search
None
See application file for complete search history.

(56) References Cited

U.S. PATENT DOCUMENTS 5,458,516 A 10/1995 Uglene et al.
2017/0112201 A1 4/2017 Lv et al.
(Continued)

FOREIGN PATENT DOCUMENTS

CN 202077650 12/2011
CN 203040692 7/2013
CN 103358605 10/2013
(Continued)

OTHER PUBLICATIONS https://patents.google.com/patent/CN210696977U/en?oq=CN210696977 (Year: 2019).*
(Continued)

*Primary Examiner* — Arti Singh-Pandey
(74) *Attorney, Agent, or Firm* — Wenderoth, Lind & Ponack, L.L.P.

(57) ABSTRACT

A cold protection material includes: a front side fabric constituting a front fabric of the cold proof garment or constituting a fabric disposed inside the front fabric; a back side fabric disposed on a back side of the front side fabric; two partition members forming a space between the front side fabric and the back side fabric; a filler made of down or feathers stored in the space; an air permeable member disposed to cover a vent hole provided in the front side fabric or the back side fabric; and a sealing member fixed to the air permeable member so as to prevent ventilation at least at a portion facing the vent hole in the air permeable member. The air permeable member allows ventilation at a portion other than a portion to which the sealing member is fixed.

7 Claims, 13 Drawing Sheets

(56) References Cited

U.S. PATENT DOCUMENTS

| | | | |
|---|---|---|---|
| 2020/0046051 | A1 | 2/2020 | Matsumoto et al. |
| 2020/0061969 | A1 | 2/2020 | Okanishi et al. |

FOREIGN PATENT DOCUMENTS

| | | |
|---|---|---|
| CN | 104621814 | 5/2015 |
| CN | 104872873 | 9/2015 |
| CN | 205072191 | 3/2016 |
| CN | 206182441 | 5/2017 |
| CN | 206744618 | 12/2017 |
| CN | 210696977 | 6/2020 |
| JP | 7-256804 | 10/1995 |
| JP | 2005-36323 | 2/2005 |
| JP | 2005-68571 | 3/2005 |
| JP | 2013-231254 | 11/2013 |
| JP | 6226703 | 11/2017 |
| JP | 6247431 | 12/2017 |
| JP | 2019-534952 | 12/2019 |
| TW | 1605950 | 11/2017 |

OTHER PUBLICATIONS

International Search Report issued Mar. 2, 2021 in International (PCT) Application No. PCT/JP2020/048467.
Office Action issued Jan. 16, 2023 in Chinese Patent Application No. 202080098872.X, with English summary.

* cited by examiner

COLD PROTECTION MATERIAL

TECHNICAL FIELD

The present invention relates to a cold protection material.

BACKGROUND ART

Conventionally, as disclosed in the following Patent Literatures 1 and 2, a cold protection material used for a cold proof garment is known. This type of cold protection material is configured such that a first fabric and a second fabric are connected by a plurality of strip members, and a filler such as down or feathers is filled in a space partitioned by adjacent strip members. Therefore, heat retaining property is secured. Since the purpose of the cold proof garment is to secure heat retaining property, the first fabric and the second fabric are made of a fabric having low air permeability so that the air in the space partitioned by the strip members does not leak out.

As described above, since the air in the space is hard to escape from the cold protection material, when heat is applied such as during cleaning, the cold proof garment may be expanded due to expansion of the air in the space. Therefore, there is a demand for allowing the air in the space to escape when necessary. However, when a mechanism for allowing the air to escape is provided, the filler in the space will come out.

CITATION LIST

Patent Literatures

Patent Literature 1: Japanese Patent No. 6226703
Patent Literature 2: Japanese Patent No. 6247431

SUMMARY OF INVENTION

An object of the present invention is to prevent the filler in a space between a front side fabric and a back side fabric from coming out while allowing the air to enter and exit the space between the front side fabric and the back side fabric.

A cold protection material according to an aspect of the present invention is a cold protection material used for a cold proof garment, and includes: a front side fabric constituting a front fabric of the cold proof garment or constituting a fabric disposed inside the front fabric; a back side fabric disposed on a back side of the front side fabric; two partition members forming a space between the front side fabric and the back side fabric; a filler made of down or feathers stored in the space; an air permeable member disposed to cover a vent hole provided in the front side fabric or the back side fabric; and a sealing member fixed to the air permeable member so as to prevent ventilation at least at a portion facing the vent hole in the air permeable member. The air permeable member allows ventilation at a portion other than a portion to which the sealing member is fixed.

A cold protection material according to another aspect of the present invention is a cold protection material used for a cold proof garment, and includes: a front side fabric constituting a front fabric of the cold proof garment or constituting a fabric disposed inside the front fabric; a back side fabric disposed on a back side of the front side fabric; two partition members forming a space between the front side fabric and the back side fabric; a filler made of down or feathers stored in the space; and an air permeable member made of an air permeable material and disposed to cover a vent hole provided in the front side fabric or the back side fabric. The air permeable member is made of a nonwoven fabric or a foam material having a thickness of 1 mm or more.

BRIEF DESCRIPTION OF DRAWINGS

FIG. 5A, FIG. 5B and FIG. 5C are views for describing a flow of air.

DESCRIPTION OF EMBODIMENTS

Hereinafter, embodiments will be described with reference to the accompanying drawings.

Note that the following embodiments are examples embodying the present invention, and are not intended to limit the technical scope of the present invention.

First Embodiment

Figure 1:
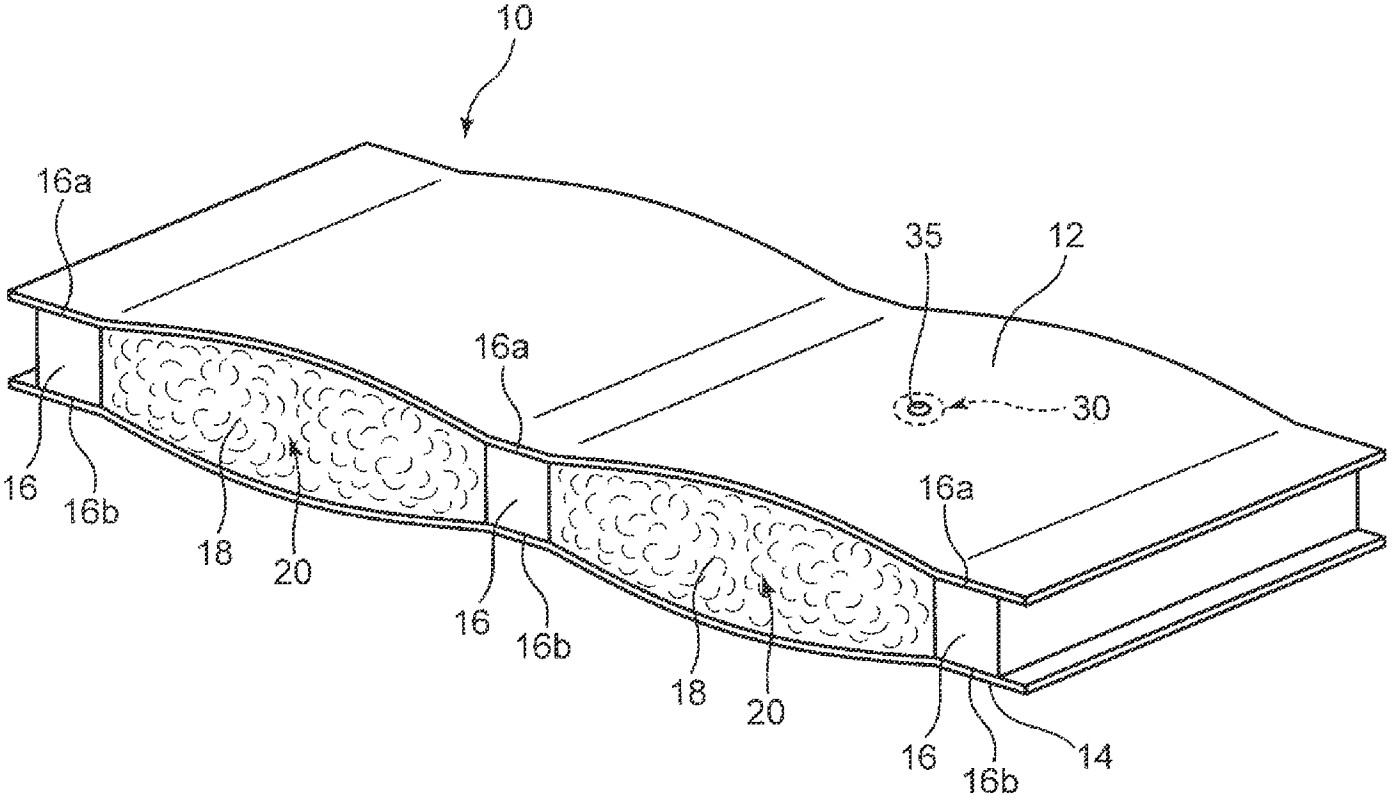
FIG. 1 is a perspective view of a cold protection material.
Figure 2:
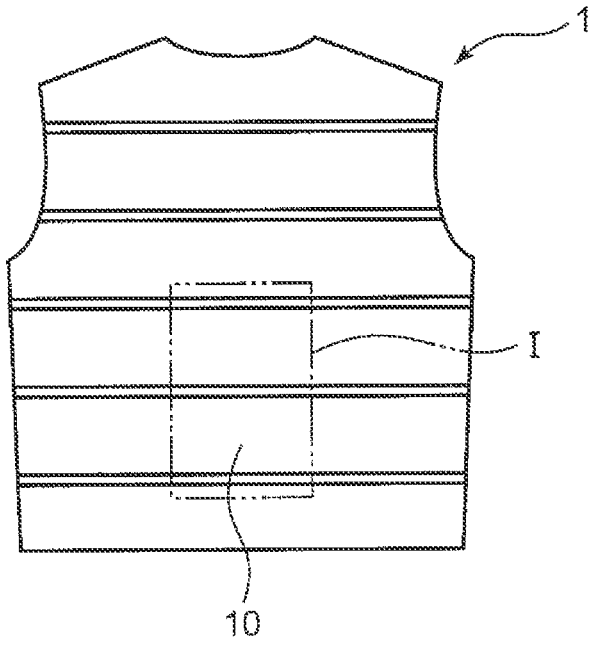
FIG. 2 is a view of a back body using the cold protection material.

A cold protection material 10 illustrated in FIG. 1 is a material used as an element of a cold proof garment having heat retaining property. The cold proof garment is, for example, a garment such as a jacket, a vest, pants, a coat, a blouson, or a parker, and is a garment excellent in heat retaining property. The cold protection material 10 may be configured as a back body 1 of the jacket, for example, as illustrated in FIG. 2. Note that FIG. 1 illustrates only a part of the cold protection material 10 constituting the back body 1. The cold protection material 10 may not be formed to constitute the back body 1, but may be formed to constitute a front body, a side body, a sleeve, a collar, and the like. The cold protection material 10 may be formed to constitute a rise and an inseam of the pants.

As illustrated in FIG. 1, the cold protection material 10 includes a front side fabric 12, a back side fabric 14, at least two partition members 16 and 16, and a filler 18.

The front side fabric 12 may constitute a front fabric (an outer fabric) of the cold proof garment, and instead of this, may constitute an inner fabric (for example, a fabric constituting a down pack) disposed inside the front fabric. The front side fabric 12 is made of synthetic fiber fabric having no air permeability or synthetic fiber fabric having almost no air permeability (or low ventilation rate). That is, the front side fabric 12 is made of a fabric having a ventilation rate of 1 $cc/cm^2/sec$ or less.

The back side fabric 14 is a fabric disposed inside the front side fabric 12, and constitutes, for example, a back fabric of the cold proof garment. However, the back side fabric 14 need not constitute the back fabric of the cold proof garment. The back side fabric 14 may constitute, for example, the inner fabric located inside the back fabric in the cold proof garment (for example, when the cold proof garment has a four-layer structure, a fabric of the third layer from the outside). The back side fabric 14 is made of synthetic fiber fabric having no air permeability or synthetic fiber fabric having almost no air permeability (or low ventilation rate). That is, the back side fabric 14 is made of a fabric having a ventilation rate of 1 $cc/cm^2/sec$ or less.

Each of the two partition members 16 and 16 is a member that connects the front side fabric 12 and the back side fabric 14, and is formed in a strip shape elongated in one direction. The two partition members 16 and 16 extend linearly in a state of being arranged parallel to each other. However, the present embodiment is not limited to this form, and each partition member 16 may be bent or may not be parallel to each other.

A front side surface 16*a* (that is, one of surfaces perpendicular to the one direction) of the partition member 16 is bonded to the front side fabric 12. A back side surface 16*b* of the partition member 16 facing a side opposite to the front side surface 16*a* is bonded to the back side fabric 14. The partition member 16 and the front side fabric 12 are bonded to each other by using a thermoplastic adhesive (hot melt), a solvent-based adhesive, a moisture curable adhesive, a UV curable adhesive, or an acrylic adhesive (adhesive that is not crosslinked). The partition member 16 and the back side fabric 14 are also bonded to each other in the same manner.

The two partition members 16 and 16 are coupled to the front side fabric 12 and the back side fabric 14, so that a space 20 is formed by the front side fabric 12, the back side fabric 14, and the two partition members 16 and 16. That is, the two partition members 16 and 16 are members for forming a closed space 20 between the front side fabric 12 and the back side fabric 14.

Each partition member 16 is formed of a flexible material. However, each partition member 16 is soft enough not to be deformed to reduce a distance between the front side surface 16*a* and the back side surface 16*b* by the weight of the front side fabric 12 or the back side fabric 14. That is, since each partition member 16 has strength enough not to be crushed or bent by the weight of the front side fabric 12 or the back side fabric 14, even when the space 20 is not filled with the filler 18, a distance between the front side fabric 12 and the back side fabric 14 in the vicinity of the partition member 16 is not reduced.

Each partition member 16 has air permeability. Therefore, since the air can pass through the partition member 16, the air can flow between adjacent spaces 20 through the partition member 16.

The filler 18 is stored in the space 20. The filler 18 is a material that is made of down or feathers, and contributes to the cold protection material 10 exhibiting heat retaining property by being confined in the space 20.

Figure 3:
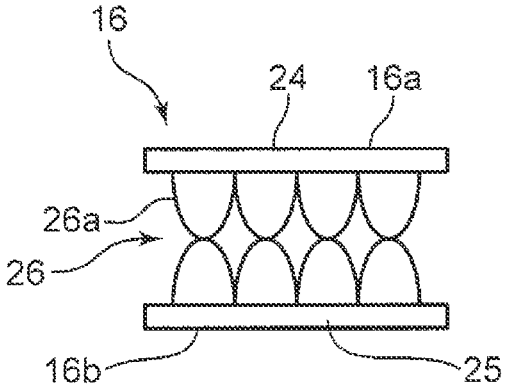
FIG. 3 is a schematic view of a partition member used for the cold protection material.

As illustrated in FIG. 3, each partition member 16 is made of a double raschel knitted fabric. That is, the partition member 16 is configured in a three-layer structure including a front fabric 24, a back fabric 25, and a ventilation layer 26. A front surface of the front fabric 24 forms the front side surface 16*a* of the partition member 16, and a back surface of the back fabric 25 forms the back side surface 16*b* of the partition member 16. The front surface of the front fabric 24 is bonded to the front side fabric 12, and the back surface of the back fabric 25 is bonded to the back side fabric 14. Then, the ventilation layer 26 is coupled to a back surface of the front fabric 24 and is coupled to a front surface of the back fabric 25.

Each of the front fabric 24 and the back fabric 25 may be made of, for example, a blended fabric (woven fabric) of nylon and polyurethane, or may be made of a polyester fabric (woven fabric). Further, the front fabric 24 and the back fabric 25 may be made of different fabrics.

The ventilation layer 26 is a portion that secures air permeability in the partition member 16, and is located between the front fabric 24 and the back fabric 25. The ventilation layer 26 is made of a knitted fabric 26*a*. The knitted fabric 26*a* is knitted into the front fabric 24 and the back fabric 25. Therefore, the front fabric 24 is not easily peeled off from the ventilation layer 26, and the back fabric 25 is also not easily peeled off from the ventilation layer 26.

Figure 4:
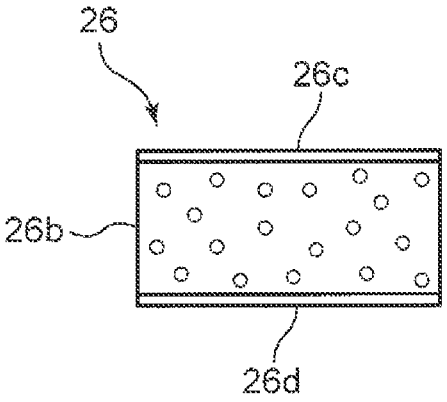
FIG. 4 is a modification of a ventilation layer provided in the partition member.

Note that the partition member 16 is not limited to a member made of a double raschel knitted fabric. Note that the ventilation layer 26 may be made of a foam material 26*b* instead of the knitted fabric 26*a*. In this case, the ventilation layer 26 is made of the foam material 26*b* having a rectangular parallelepiped shape, and the foam material 26*b* is bonded to the front fabric 24 and the back fabric 25. Further, as illustrated in FIG. 4, laminate layers 26*c* and 26*d* may be respectively bonded to a front surface and a back surface of the foam material 26*b*, the front fabric 24 may be bonded to the laminate layer 26*c* on the front side, and the back fabric 25 may be bonded to the laminate layer 26*d* on the back side. Further, the ventilation layer 26 may be made of a nonwoven fabric.

The partition member 16 may be made of the foam material instead of the double raschel knitted fabric.

Figure 5A:
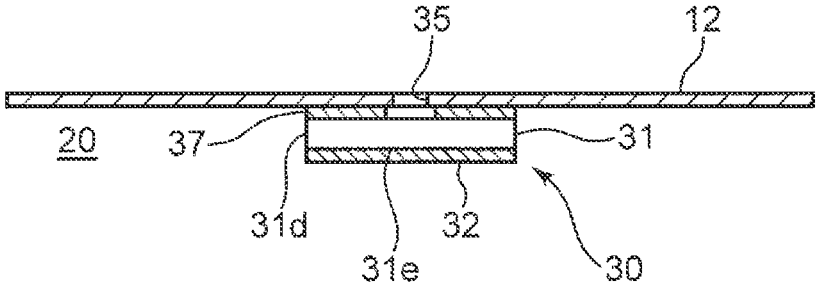
FIG. 5A is a view for describing a ventilator used for the cold protection material.

In the cold protection material 10, the space 20 is desirably ventilated. Therefore, as illustrated in FIGS. 1 and 5A, the cold protection material 10 includes a ventilator 30 for allowing the air to enter and exit the space 20. That is, the cold protection material 10 is provided with the ventilator 30 so that the air in the space 20 can escape to the outside of the cold protection material 10 or the outside air can betaken into the space 20. However, the ventilator 30 is configured such that the filler 18 does not come out of the space 20 when the air in the space 20 leaks to the outside.

FIGS. 1 and 5A illustrate a configuration in which the ventilator 30 is disposed on the front side fabric 12, but the ventilator 30 may be disposed on the back side fabric 14. Further, each space 20 may be provided with the ventilator 30, but one ventilator 30 may be provided for the plurality of spaces 20. Furthermore, FIGS. 1 and 5A illustrate a configuration in which the ventilator 30 is disposed in the space 20, but the ventilator 30 may be disposed outside the space 20. For example, the ventilator 30 may be disposed on the front side of the front side fabric 12 or may be disposed on the back side of the back side fabric 14.

As illustrated in FIG. 5A, the ventilator 30 includes an air permeable member 31 and a sealing member 32. The air permeable member 31 is an air permeable material, and is disposed to cover a vent hole 35 provided in the front side fabric 12. Therefore, the air in the space 20 flows out to the outside through the vent hole 35 and the air permeable member 31. The sealing member 32 is a non air permeable material, and prevents ventilation at a position opposite the vent hole 35 while securing air permeability by the air permeable member 31.

Figure 6:
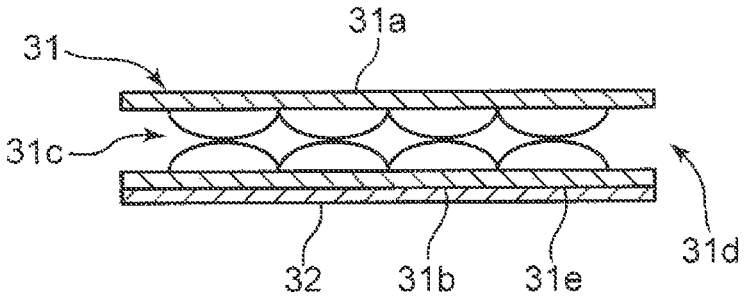
FIG. 6 is a view for describing an air permeable member provided in the ventilator.

As illustrated in FIG. 6, the air permeable member 31 is made of a double raschel knitted fabric. That is, the air permeable member 31 is configured in a three-layer structure including an inner layer 31*a*, an outer layer 31*b*, and a ventilation layer 31*c*. The inner layer 31*a* includes an inner surface (a fabric side surface) bonded to the front side fabric 12 in which the vent hole 35 is formed, and the outer layer 31*b* includes an outer surface (an opposite side surface) 31*e* of the air permeable member 31. An adhesive layer 37 exists between the inner layer 31*a* and the front side fabric 12. However, the adhesive layer 37 does not close the vent hole 35, and is formed around the vent hole 35. That is, after the adhesive layer 37 is fixed to the front side fabric 12, processing of forming the vent hole 35 in the front side fabric 12 from the adhesive layer 37 side is performed, so that a hole is also formed in the adhesive layer 37, and the adhesive layer 37 can be formed so as not to close the vent hole 35. Note that when the vent hole 35 is formed in the back side fabric 14, the inner layer 31*a* is bonded to the back side fabric 14.

Each of the inner layer 31*a* and the outer layer 31*b* may be made of, for example, a blended fabric (woven fabric) of nylon and polyurethane, or may be made of a polyester fabric (woven fabric). Further, the inner layer 31*a* and the outer layer 31*b* may be made of different fabrics. In either case, the inner layer 31*a* and the outer layer 31*b* have air permeability.

The ventilation layer 31*c* is located between the inner layer 31*a* and the outer layer 31*b*, and is exposed on an outer peripheral surface (an outer peripheral side surface in FIG. 5A) 31*d* of the air permeable member 31. The ventilation layer 31*c* is made of a knitted fabric. Therefore, the ventilation layer 31*c* has higher air permeability than the inner layer 31*a* and the outer layer 31*b*. That is, the inner layer 31*a* and the outer layer 31*b* are inferior in air permeability to the ventilation layer 31*c*. Since the inner layer 31*a* is bonded to the front side fabric 12 via the adhesive layer 37 while the ventilation layer 31*c* is coupled to the inner layer 31*a*, it is possible to secure adhesive force of the inner layer 31*a* to the front side fabric 12 while securing air permeability of the air permeable member 31 by the ventilation layer 31*c*. Therefore, as compared with the case where the air permeable member 31 itself is made of a nonwoven fabric, not only the adhesive force of the air permeable member 31 can be improved, but also the adhesive force of the air permeable member 31 to the front side fabric 12 can be maintained even when used for a long period of time.

The knitted fabric is knitted into the inner layer 31*a* and the outer layer 31*b*. Therefore, the inner layer 31*a* is not easily peeled off from the ventilation layer 31*c*, and the outer layer 31*b* is also not easily peeled off from the ventilation layer 31*c*. Note that the ventilation layer 31*c* may be bonded to the inner layer 31*a* or may be bonded to the outer layer 31*b*. That is, the ventilation layer 31*c* is coupled to the inner layer 31*a* and is also coupled to the outer layer 31*b*.

Note that the air permeable member 31 is not limited to a member made of a double raschel knitted fabric. For example, the ventilation layer 31*c* may be made of the foam material instead of the knitted fabric. That is, the air permeable member 31 may have a three-layer structure of the inner layer 31*a*, the ventilation layer 31*c* made of the foam material, and the outer layer 31*b*. In this case, the foam material is bonded to the inner layer 31*a* and the outer layer 31*b*.

Further, the ventilation layer 31*c* may be made of a woven fabric or a nonwoven fabric instead of the knitted fabric. When the ventilation layer 31*c* is made of the woven fabric, the woven fabric is preferably rougher than the inner layer 31*a* and the outer layer 31*b*. In this case, the woven and nonwoven fabrics may be bonded to the inner layer 31*a* and the outer layer 31*b*.

Further, the air permeable member 31 may be made of a nonwoven fabric, a woven fabric, a knitted fabric, or a foam material.

Figure 5B:
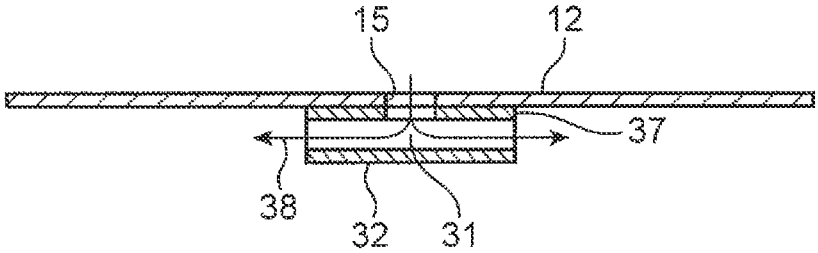
Figure 5C:
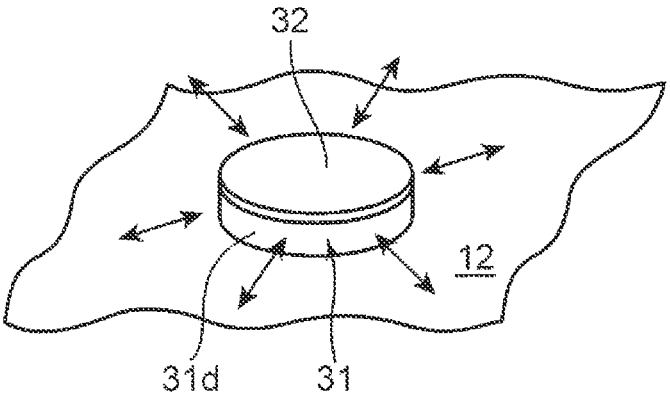

The sealing member 32 has the same size as the air permeable member 31, and is fixed to the outer surface 31*e* of the air permeable member 31, that is, a surface of the air permeable member 31 facing an opposite side to the front side fabric 12 in which the vent hole 35 is formed. Therefore, the entire outer surface 31*e* of the air permeable member 31 is covered with the sealing member 32. That is, ventilation in a portion facing the vent hole 35 in the air permeable member 31 is prevented by the sealing member 32. On the other hand, the outer peripheral surface 31*d* (side surface in FIG. 6) of the air permeable member 31 is not covered with the sealing member 32. Therefore, ventilation at the outer peripheral surface 31*d* of the air permeable member 31 is allowed. That is, since the air permeable member 31 is exposed in a direction intersecting a direction of the vent hole 35, ventilation in this direction is allowed. Therefore, as illustrated in FIG. 5B, a direction of a flow of air 38 passing through the vent hole 35 is bent by the sealing member 32. Since the entire outer peripheral surface 31*d* is exposed, the air permeable member 31 can be ventilated in the entire circumferential direction. Note that as illustrated in FIG. 5C, the air permeable member 31 and the sealing member 32 may be formed in a circular shape in plan view. However, the shape is not limited to the circular shape.

The sealing member 32 can be made of a seam tape for blocking a needle hole and waterproofing, and is a member having a resin film and an adhesive layer. The resin film is a film made of a resin such as polyurethane, nylon, or polyester. The adhesive layer includes a thermoplastic adhesive (hot melt), a solvent-based adhesive, a moisture curable adhesive, a UV curable adhesive, or an acrylic adhesive (adhesive that is not crosslinked). Note that the sealing member 32 may be made of a cured adhesive.

Figure 7:
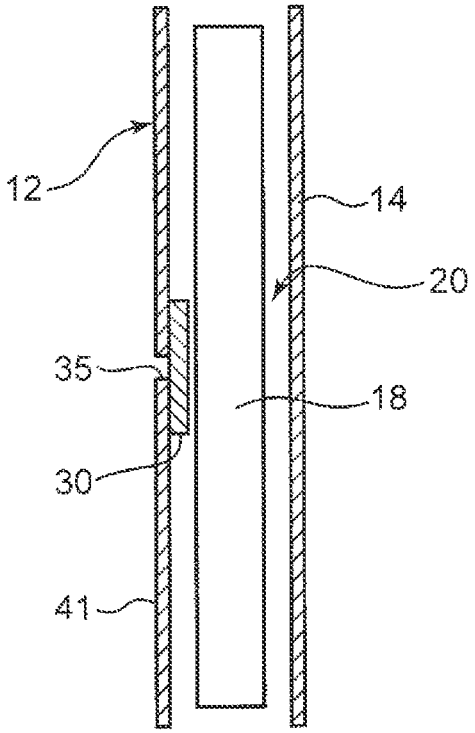
FIG. 7 is a view of the cold protection material when the ventilator is attached to a front side fabric in a case where the front side fabric and a back side fabric are each one layer.
Figure 8A:
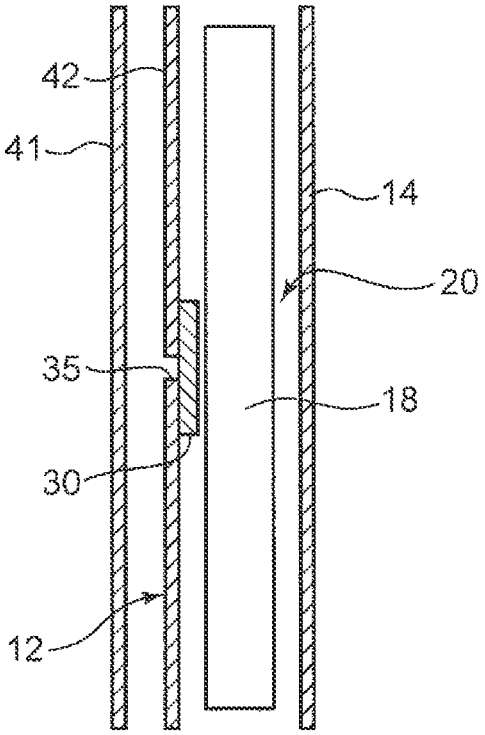
FIG. 8A is a view of the cold protection material when the ventilator is attached to a front side inner fabric.
Figure 8B:
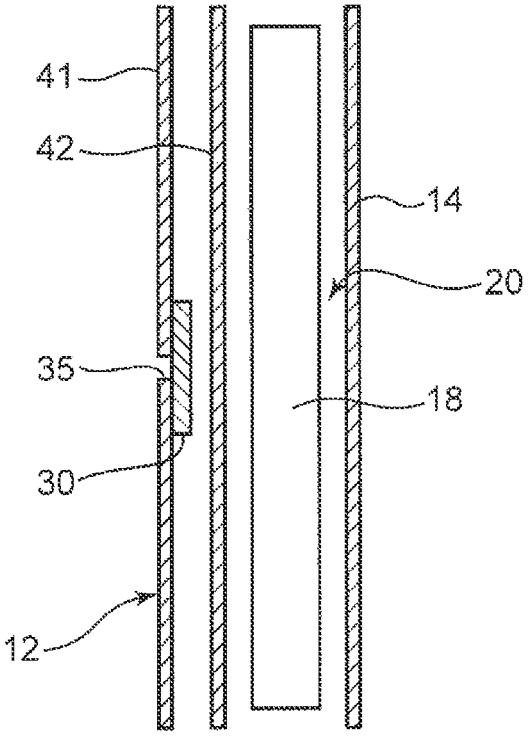
FIG. 8B is a view of the cold protection material when the ventilator is attached to a front fabric, in a case where the front side fabric has two layers and the back side fabric has one layer.
Figure 9A:
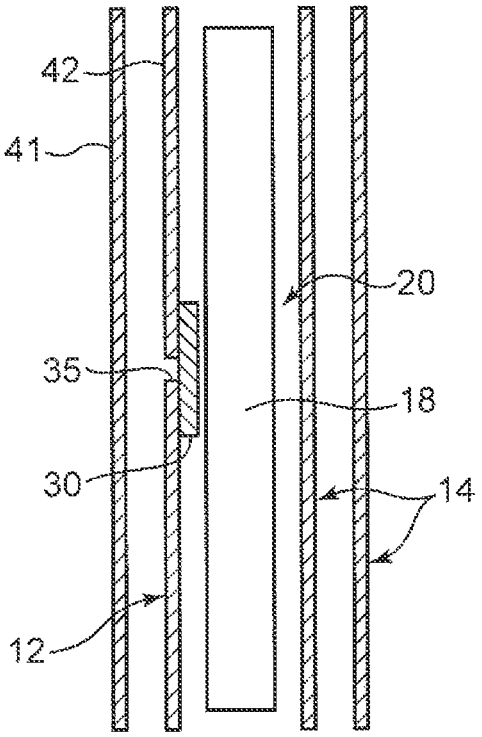
FIG. 9A is a view of the cold protection material when the ventilator is attached to the front side inner fabric.
Figure 9B:
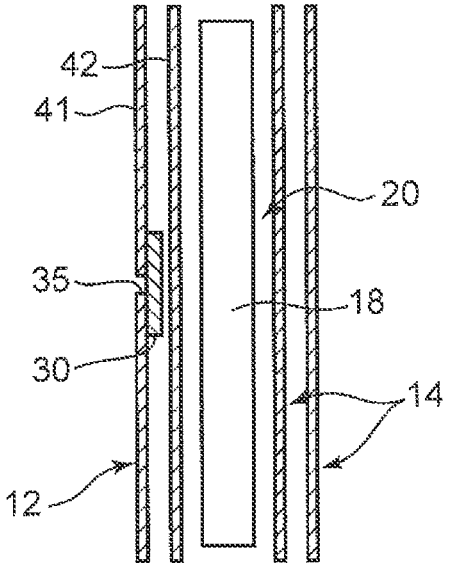
FIG. 9B is a view of the cold protection material when the ventilator is attached to the front fabric, in a case where the front side fabric and the back side fabric each has two layers.

In an example of FIG. 1, the ventilator 30 is provided on the front side fabric 12. That is, as illustrated in FIG. 7, if the front side fabric 12 and the back side fabric 14 of the cold protection material 10 are each one layer, the ventilator 30 is provided on a front fabric 41 constituting the front side fabric 12. Further, as illustrated in FIGS. 8A, 8B, 9A, and 9B, when the front fabric 41 and a front side inner fabric 42 inside the front fabric 41 exist on the front side of the filler 18, the ventilator 30 is provided on the front fabric 41 or the front side inner fabric 42. That is, the front fabric 41 or the front side inner fabric 42 functions as the front side fabric 12. Note that FIGS. 8A and 8B illustrate a case where the back side of the filler 18 is one layer, and FIGS. 9A and 9B illustrate a case where the back side is two layers. As illustrated in FIGS. 8A and 9A, when the ventilator 30 is provided on the front side inner fabric 42 functioning as the front side fabric 12, the front fabric 41 is not restricted, so that it is superior in design. On the other hand, even when the ventilator 30 is provided on the front fabric 41 as illustrated in FIGS. 7, 8B, and 9B, the air permeability is secured. Note that in the case of FIGS. 8B and 9B, the front side inner fabric 42 is made of a fabric having air permeability, and the front fabric 41 functioning as the front side fabric 12 is made of a fabric having no air permeability or almost no air permeability. In any case, the ventilator 30 is disposed in the space 20.

Figure 10:
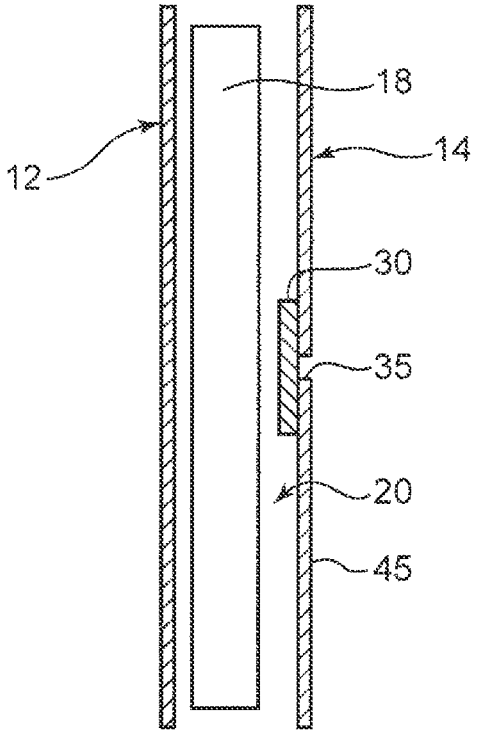
FIG. 10 is a view of the cold protection material when the ventilator is attached to the back side fabric in a case where the front side fabric and the back side fabric are each one layer.
Figure 11A:
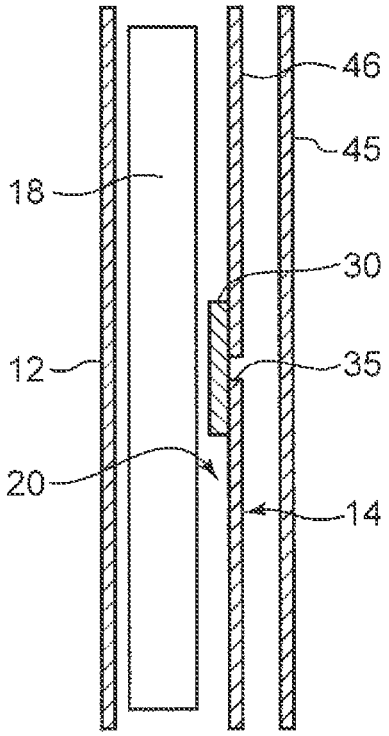
FIG. 11A is a view of the cold protection material when the ventilator is attached to the back side inner fabric.
Figure 11B:
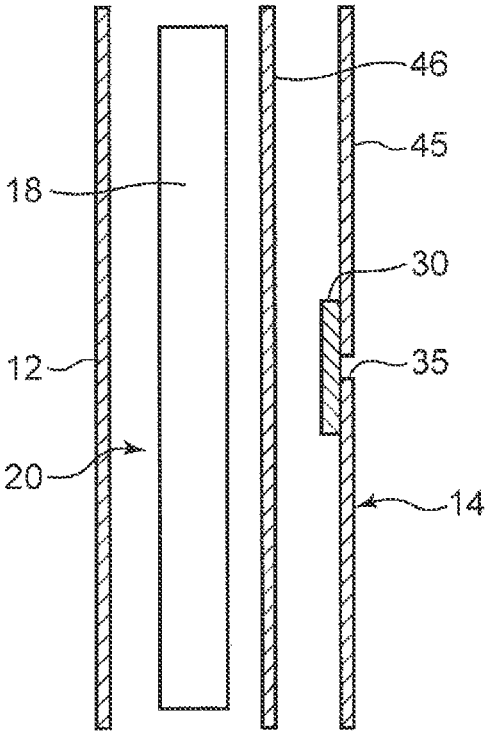
FIG. 11B is a view of the cold protection material when the ventilator is attached to a back fabric, in a case where the front side fabric has one layer and the back side fabric has two layers.
Figure 12A:
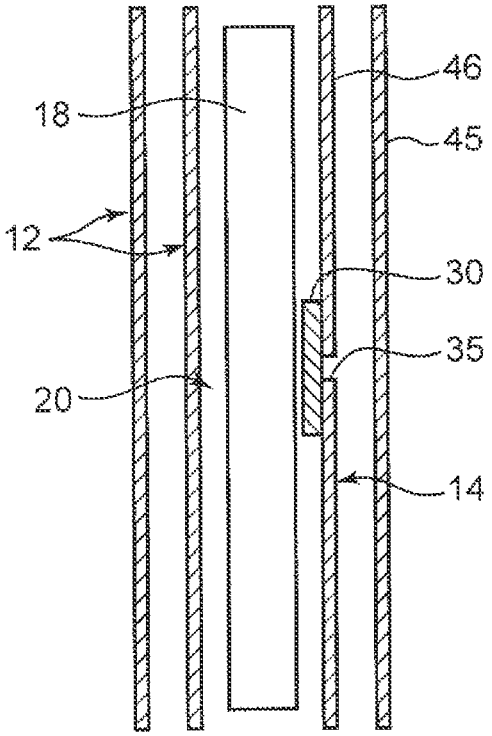
FIG. 12A is a view of the cold protection material when the ventilator is attached to the back side inner fabric.
Figure 12B:
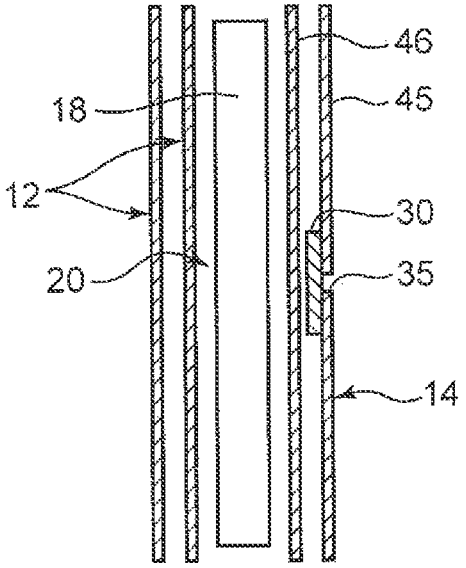
FIG. 12B is a view of the cold protection material when the ventilator is attached to the back fabric, in the case where the front side fabric and the back side fabric each has two layers.

As illustrated in FIGS. 10 to 12B, the ventilator 30 may be provided on the back side fabric 14. That is, as illustrated in FIG. 10, if the front side fabric 12 and the back side fabric 14 are each one layer, the ventilator 30 is provided on a back fabric 45 constituting the back side fabric 14. Further, as illustrated in FIGS. 11A, 11B, 12A, and 12B, when the back fabric 45 and a back side inner fabric 46 inside the back fabric 45 exist on the back side of the filler 18, the ventilator 30 is provided on the back fabric 45 or the back side inner fabric 46. That is, the back fabric 45 or the back side inner fabric 46 functions as the backside fabric 14. Note that FIGS. 11A and 11B illustrate a case where the front side of the filler 18 is one layer, and FIGS. 12A and 12B illustrate a case where the front side is two layers. Even when the ventilator 30 is provided on the back side fabric 14, the air permeability is secured. Further, in a configuration of FIG. 10, since warm air flows into the space 20 from the inside of the cold proof garment, the inside of the space 20 is easily warmed. Further, in a configuration of FIGS. 11A and 12A, the back side inner fabric 46 functioning as the back side fabric 14 is made of a fabric having no air permeability or almost no air permeability. If a fabric having high ventilation rate is used for the back fabric 45, since the warm air flows into the space 20 from the inside of the cold proof garment, the inside of the space 20 is easily warmed. Note that in the case of FIGS. 11B and 12B, the back side inner fabric 46 is made of a fabric having air permeability, and the back fabric 45 functioning as the back side fabric 14 is made of a fabric having no air permeability or almost no air permeability. In any case, the ventilator 30 is disposed in the space 20.

As described above, according to the present embodiment, the space 20 partitioned by the two partition members 16 between the front side fabric 12 and the back side fabric 14 is ventilated to and from the outside of the space 20 through the vent hole 35 and the air permeable member 31. Therefore, the air 38 from the vent hole 35 can leak out to the outside through the air permeable member 31. At this time, in the air permeable member 31, ventilation is performed through a portion other than a portion to which the sealing member 32 is fixed. On the other hand, outside air can enter the vent hole 35 through the air permeable member 31 from a portion other than the sealing member 32. That is, since the ventilation is performed through the ventilator 30, pressure is hardly applied to a seam provided in the cold protection material 10, and as a result, it is also possible to suppress the filler 18 from coming out from the seam.

The sealing member 32 is fixed to the air permeable member 31 so as to prevent ventilation at least at a portion facing the vent hole 35. Therefore, as illustrated in FIG. SB, the air 38 flowing out from the vent hole 35 does not go straight from the vent hole 35, but changes its flow direction by the sealing member 32 and then leaks out to the outside. Therefore, even if the filler 18 in the space 20 tries to pass through the vent hole 35 and the air permeable member 31, since the filler 18 hits the sealing member 32, the filler 18 cannot come out of the air permeable member 31. Therefore, while ventilation between the inside and the outside of the space 20 can be allowed, it is possible to prevent the filler 18 made of down or feathers from coming out to the outside.

In addition, since the sealing member 32 has the resin film, it is possible to prevent ventilation at the position opposite the vent hole 35 while reducing protrusion from the front side fabric 12 or the back side fabric 14 provided with the vent hole 35.

Further, since the air permeable member 31 has the three-layer structure including the inner layer 31*a*, the ventilation layer 31*c*, and the outer layer 31*b*, the inner layer 31*a* that allows ventilation between the vent hole 35 and the ventilation layer 31*c* ensures strength of adhesion of the air permeable member 31 to the front side fabric 12 (or the back side fabric 14). Furthermore, since the ventilation layer 31*c* is exposed on the outer peripheral surface 31*d* of the air permeable member 31, the ventilation is performed on the outer peripheral surface 31*d*.

Since the air permeable member 31 is bonded to the front side fabric 12 or the back side fabric 14 around the vent hole 35, even if the adhesive layer 37 is provided between the air permeable member 31 and the front side fabric 12 or the back side fabric 14 provided with the vent hole 35, ventilation of the vent hole 35 is ensured.

In addition, since the ventilator 30 is disposed in the space 20, the air permeable member 31 and the sealing member 32 do not protrude from the front side fabric 12 or the back side fabric 14.

Figure 13:
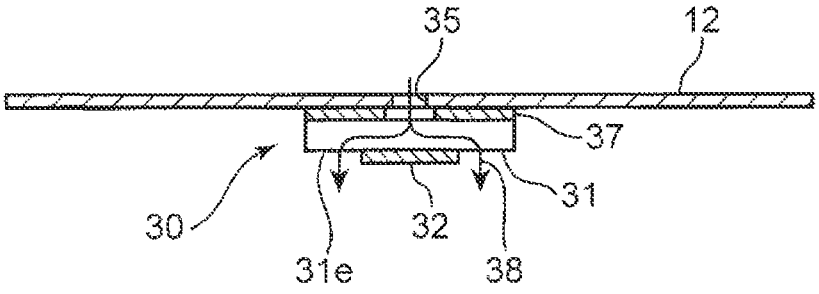
FIG. 13 is a view illustrating a modification of the ventilator.

Note that in the present embodiment, the sealing member 32 covers the entire outer surface 31*e* (the surface facing the opposite side to the front side fabric 12 in which the vent hole 35 is formed) of the air permeable member 31, but the present invention is not limited thereto. For example, the sealing member 32 may cover only a part of the outer surface 31*e* of the air permeable member 31. However, as illustrated in FIG. 13, the sealing member 32 needs to be disposed to include a portion facing the vent hole 35 (a portion having the same size as the vent hole 35). In this configuration, the air permeability can be improved as compared with a configuration in which the entire outer surface 31*e* is covered. Moreover, since the flow direction of the air 38 that tries to come out from the vent hole 35 is bent by the sealing member 32, the filler 18 hardly comes out from the air permeable member 31.

Figure 14:
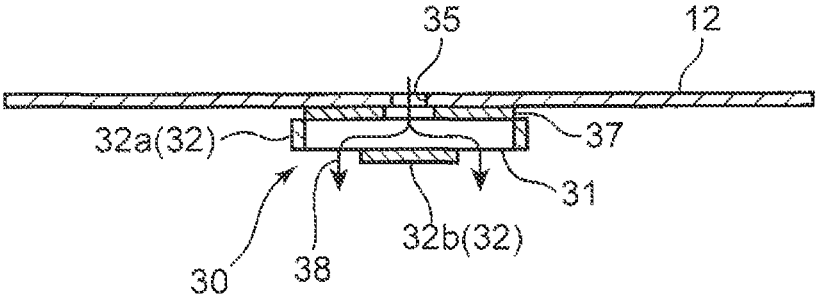
FIG. 14 is a view illustrating another modification of the ventilator.

Further, as illustrated in FIG. 14, the sealing member 32 may be configured to have an outer peripheral portion 32*a* that covers the outer peripheral surface 31*d* of the air permeable member 31, and an outer surface portion 32*b* that covers only a part of the outer surface 31*e* of the air permeable member 31. In this case, the outer surface portion 32*b* is disposed to include the portion facing the vent hole 35 (the portion having the same size as the vent hole 35).

Figure 15:
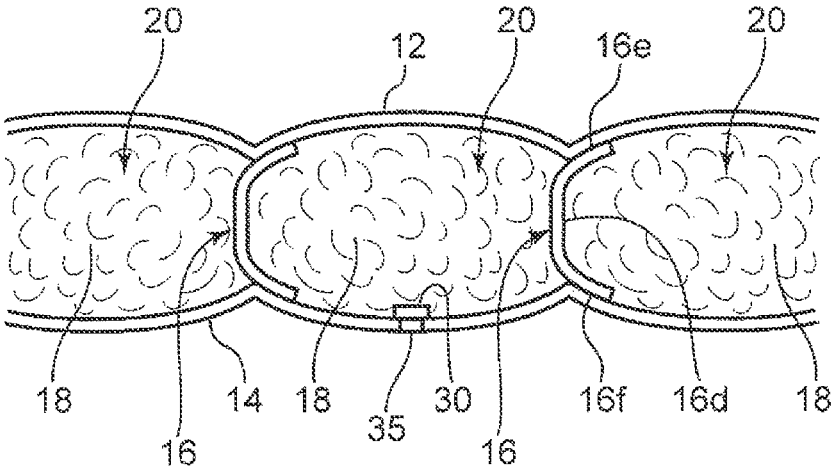
FIG. 15 is a view of the cold protection material in a case where the partition member has a bent shape.
Figure 16:
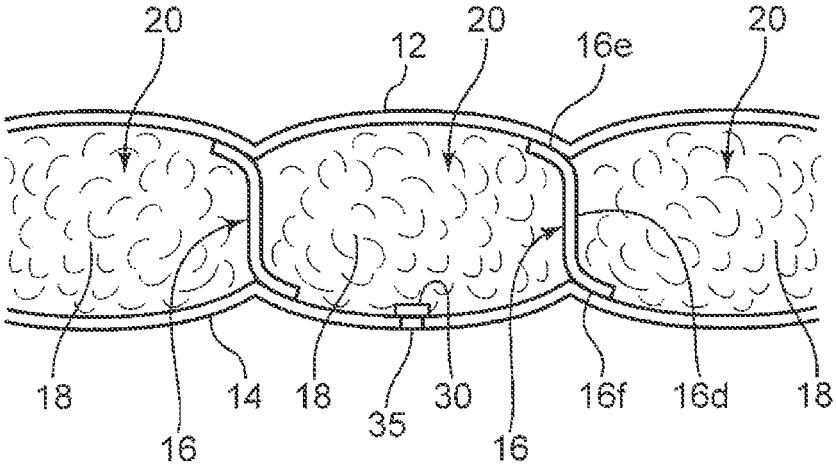
FIG. 16 is a view of the cold protection material in another case where the partition member has a bent shape.

Further, in the present embodiment, the partition member 16 is made of a member having a cross section that is not bent, but the present embodiment is not limited thereto. For example, as illustrated in FIGS. 15 and 16, the partition member 16 may include a partition wall portion 16*d*, a front side portion 16*e* that extends from one end portion of the partition wall portion 16*d* so as to be bent from the partition wall portion 16*d* and is bonded to the front side fabric 12, and a back side portion 16*f* that extends from the other end of the partition wall portion 16*d* so as to be bent from the partition wall portion 16*d* and is bonded to the back side fabric 14. FIG. 15 illustrates a form in which the front side portion 16*e* and the back side portion 16*f* are bent in the same direction, and FIG. 16 illustrates a form in which the front side portion and the back side portion are bent in opposite directions.

Second Embodiment

Figure 17:
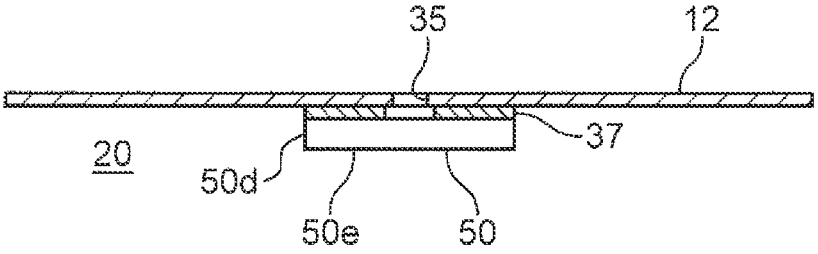
FIG. 17 is a view for describing the cold protection material according to a second embodiment.

FIG. 17 illustrates a second embodiment of the present invention. Here, the same components as those of the first embodiment are denoted by the same reference numerals, and a detailed description thereof will be omitted.

In the first embodiment, the ventilator 30 having the air permeable member 31 and the sealing member 32 is provided. On the other hand, in the second embodiment, the sealing member 32 is not provided, and an air permeable member 50 itself prevents the filler 18 from coming out.

The air permeable member 50 is disposed to cover the vent hole 35 provided in the front side fabric 12. The adhesive layer 37 exists between the air permeable member 50 and the front side fabric 12. However, the adhesive layer 37 does not close the vent hole 35, and is formed around the vent hole 35. Note that when the vent hole 35 is formed in the back side fabric 14, the air permeable member 50 is bonded to the back side fabric 14. The air permeable member 50 can be disposed at a position where the ventilator 30 is disposed as illustrated in FIGS. 7 to 12B.

The air permeable member 50 is made of a nonwoven fabric or a foam material having a thickness of 1 mm or more. Therefore, since the air permeable member 50 is air permeable but does not have high air permeability, the filler 18 hardly passes through the air permeable member 31. The sealing member 32 is not provided on an outer surface 50*e* and an outer peripheral surface 50*d* of the air permeable member 50, and the outer surface 50*e* and the outer peripheral surface 50*d* are exposed, but it is possible to prevent the filler 18 made of down or feathers from coming out to the outside. Note that the thickness of the air permeable member 50 may be 3 mm or less.

In the first embodiment, since the sealing member 32 is provided, even if the thickness of the air permeable member 31 is less than 1 mm, the filler 18 can be prevented from coming out.

Although descriptions of other configurations, operations, and effects are omitted, the description of the first embodiment can be applied to the second embodiment.

Outline of Embodiments

Here, the embodiment will be outlined.

(1) The cold protection material according to the embodiment is a cold protection material used for a cold proof garment, including: a front side fabric constituting a front fabric of the cold proof garment or constituting a fabric disposed inside the front fabric; a back side fabric disposed on a back side of the front side fabric; two partition members forming a space between the front side fabric and the back side fabric; a filler made of down or feathers stored in the space; an air permeable member disposed to cover a vent hole provided in the front side fabric or the back side fabric; and a sealing member fixed to the air permeable member so as to prevent ventilation at least at a portion facing the vent hole in the air permeable member. The air permeable member allows ventilation at a portion other than a portion to which the sealing member is fixed.

In the cold protection material, a space partitioned by the two partition members between the front side fabric and the back side fabric is ventilated to and from the outside of the space through the vent hole and the air permeable member. Therefore, the air from the vent hole can leak out to the outside through the air permeable member. At this time, in the air permeable member, the ventilation is performed through the portion other than the portion to which the sealing member is fixed. On the other hand, the outside air can enter the vent hole through the air permeable member from the portion other than the sealing member. That is, since the ventilation is performed through the air permeable member, the pressure is hardly applied to the seam provided in the cold protection material, and as a result, it is also possible to suppress the filler from coming out from the seam.

The sealing member is fixed to the air permeable member so as to prevent ventilation at least at a portion facing the vent hole. Therefore, the air flowing out from the vent hole does not go straight from the vent hole, but changes the flow direction by the sealing member and then leaks out to the outside. Therefore, even if the filler in the space tries to pass through the vent hole and the air permeable member, since the filler hits the sealing member, the filler cannot come out of the air permeable member. Therefore, while the ventilation between the inside and the outside of the space between the front side fabric and the back side fabric can be allowed, it is possible to prevent the filler made of down or feathers from coming out to the outside.

(2) The air permeable member may include a nonwoven fabric, a woven fabric, a knitted fabric, a double raschel knitted fabric, or a foam material. In this aspect, it is possible to secure the air permeability of the air permeable member while suppressing weight of the air permeable member from increasing too much.

(3) The sealing member may have a resin film. In this aspect, since the sealing member has a thin film, it is possible to prevent ventilation at the position opposite the vent hole while reducing protrusion from the front side fabric or the back side fabric provided with the vent hole.

(4) The air permeable member may include: a ventilation layer; an inner layer that is located on one side of the ventilation layer, the inner layer being bonded to the front side fabric or the back side fabric provided with the vent hole, and the inner layer being inferior in air permeability to the ventilation layer; and an outer layer that is located on the other side of the ventilation layer and is inferior in air permeability to the ventilation layer. In this case, ventilation is performed between the vent hole and the ventilation layer through the inner layer.

In this aspect, the inner layer that allows ventilation between the vent hole and the ventilation layer ensures the strength of adhesion of the air permeable member to the front side fabric or the back side fabric provided with the vent hole. Note that, in this aspect, when the ventilation layer is exposed on the outer peripheral surface of the air permeable member, the ventilation is performed on the outer peripheral surface.

(5) The air permeable member may be bonded to the front side fabric or the back side fabric around the vent hole. In this aspect, even if the adhesive layer is provided between the air permeable member and the front side fabric or the back side fabric provided with the vent hole, the ventilation of the vent hole is ensured.

(6) The air permeable member and the sealing member may be arranged in the space. In this aspect, the air permeable member and the sealing member do not protrude from the front side fabric or the back side fabric.

(7) The cold protection material according to the second embodiment is a cold protection material used for a cold proof garment, including: a front side fabric constituting a front fabric of the cold proof garment or constituting a fabric disposed inside the front fabric; a back side fabric disposed on a back side of the front side fabric; two partition members forming a space between the front side fabric and the back side fabric; a filler made of down or feathers stored in the space; and an air permeable member made of an air permeable material and disposed to cover a vent hole provided in the front side fabric or the back side fabric. The air permeable member is made of a nonwoven fabric or a foam material having a thickness of 1 mm or more.

In the cold protection material, a space partitioned by the two partition members between the front side fabric and the back side fabric is ventilated to and from the outside of the space through the vent hole and the air permeable member. Therefore, the air from the vent hole can leak out to the outside through the air permeable member. On the other hand, the outside air can enter the vent hole through the air permeable member. Since the ventilation is performed through the air permeable member, the pressure is hardly applied to the seam provided in the cold protection material, and as a result, it is also possible to suppress the filler from coming out from the seam. However, since the air permeable member is made of a nonwoven fabric or a foam material having a thickness of 1 mm or more, the ventilation rate is low, and the filler can be suppressed from coming off. Therefore, it is possible to prevent the filler made of down or feathers from coming out to the outside while allowing the air to enter and exit the space between the front side fabric and the back side fabric.

The invention claimed is:

1. A cold protection material used for a cold proof garment, comprising:

a front side fabric constituting a front fabric of the cold proof garment or constituting a fabric disposed inside the front fabric;

a back side fabric disposed on a back side of the front side fabric;

two partition members forming a space between the front side fabric and the back side fabric;

a filler made of down or feathers stored in the space;

an air permeable member disposed to cover a vent hole provided in the front side fabric or the back side fabric; and a sealing member fixed to the air permeable member so as to prevent ventilation at least at a portion facing the vent hole in the air permeable member, wherein the air permeable member allows ventilation at a portion other than a portion to which the sealing member is fixed, and wherein the air permeable member is bonded by an adhesive layer to the front side fabric or the back side fabric that is provided with the vent hole, the vent hole communicating with a hole penetrating the adhesive layer.

2. The cold protection material according to claim 1, wherein the air permeable member includes a nonwoven fabric, a woven fabric, a knitted fabric, a double raschel knitted fabric, or a foam material.

3. The cold protection material according to claim 1, wherein the sealing member has a resin film.

4. The cold protection material according to claim 1, wherein the air permeable member includes: a ventilation layer; an inner layer that is located on one side of the ventilation layer, the inner layer being bonded to the front side fabric or the back side fabric provided with the vent hole, and the inner layer being inferior in air permeability to the ventilation layer; and an outer layer that is located on the other side of the ventilation layer and is inferior in air permeability to the ventilation layer, and ventilation is performed between the vent hole and the ventilation layer through the inner layer.

5. The cold protection material according to claim 1, wherein the air permeable member is bonded to the front side fabric or the back side fabric around the vent hole.

6. The cold protection material according to claim 1, wherein the air permeable member and the sealing member are arranged in the space.

7. A cold protection material used for a cold proof garment, comprising:

a front side fabric constituting a front fabric of the cold proof garment or constituting a fabric disposed inside the front fabric;

a back side fabric disposed on a back side of the front side fabric;

two partition members forming a space between the front side fabric and the back side fabric;

a filler made of down or feathers stored in the space; and an air permeable member made of an air permeable material and disposed to cover a vent hole provided in the front side fabric or the back side fabric, wherein the air permeable member is made of a nonwoven fabric or a foam material having a thickness of 1 mm or more, and wherein the air permeable member is bonded by an adhesive layer to the front side fabric or the back side fabric that is provided with the vent hole, the vent hole communicating with a hole penetrating the adhesive layer.

* * * * *